United States Patent [19]

Woodhead et al.

[11] Patent Number: 4,908,545

[45] Date of Patent: Mar. 13, 1990

[54] CATHODE RAY TUBE

[75] Inventors: Alfred W. Woodhead, Caterham; Ronald W. A. Gill; Alan G. Knapp, both of Crawley; Daphne L. Lamport, Caterham; Derek Washington, Wallington, all of United Kingdom

[73] Assignee: U.S. Philips Corporation, New York, N.Y.

[21] Appl. No.: 913,614

[22] Filed: Sep. 26, 1986

Related U.S. Application Data

[63] Continuation of Ser. No. 626,964, Jul. 2, 1984, abandoned.

[30] Foreign Application Priority Data

Jul. 8, 1983 [GB] United Kingdom ..... 8318495

[51] Int. Cl.[4] ..... H01J 29/06; H01J 43/28

[52] U.S. Cl. ..... 313/103 CM; 313/422; 313/106

[58] Field of Search ..... 313/422, 103 CM, 105 CM, 313/105 R, 103 R, 106, 107

[56] References Cited

U.S. PATENT DOCUMENTS

| | | | |
|---|---|---|---|
| 3,148,304 | 9/1964 | Vieth et al. | 313/422 |
| 3,171,056 | 2/1965 | Gabor | 313/422 |
| 3,395,303 | 7/1968 | Kajiyama | 313/106 |
| 3,914,634 | 10/1975 | Overall et al. | 313/105 CM |
| 3,974,411 | 8/1976 | Faulkner et al. | 313/105 CM |
| 4,099,079 | 7/1978 | Knapp | 313/103 CM |
| 4,422,005 | 12/1983 | Washington et al. | 313/105 CM |
| 4,482,836 | 11/1984 | Washington et al. | 313/105 CM |
| 4,511,822 | 4/1985 | Washington et al. | 313/105 CM |

FOREIGN PATENT DOCUMENTS

| | | | |
|---|---|---|---|
| 0357624 | 1/1973 | U.S.S.R. | 313/103 |
| 0807997 | 1/1959 | United Kingdom | 313/105 |
| 2101396 | 1/1983 | United Kingdom | 313/422 |

*Primary Examiner*—Kenneth Wieder
*Attorney, Agent, or Firm*—Robert J. Kraus

[57] ABSTRACT

In order to reduce contrast degradation in an electrostatically scanned flat cathode ray tube having a channel plate electron multiplier due to back-scattered electrons entering channels remote from their origin, steps are taken to restrict the acceptance angle of the channel plate electron multiplier. In one arrangement means are provided on the input surface to restrict the angle of entry to a range normally associated with the addressing electron beam. In another arrangement the ready emission of secondary electrons is restricted to a predetermined arcuate portion of the input of each channel of the electron multiplier. In either arrangement stray electrons are unable to impinge upon the secondary emitting material in the channels and in consequence produce many fewer back-scattered electrons. Optionally a material having a low back-scatter coefficient and a microscopically rough surface texture may be applied to the exposed surfaces, apart from the apertures, of the input side of the electron multiplier to reduce the number of back-scattered electrons.

17 Claims, 3 Drawing Sheets

Fig.8.
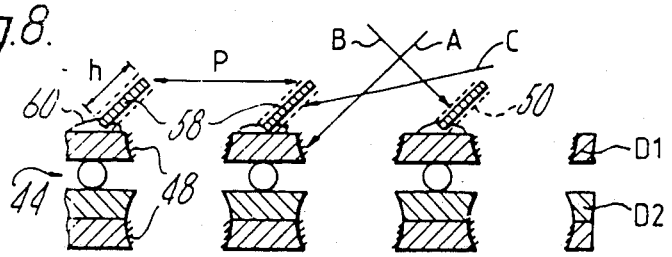
Fig.9A.
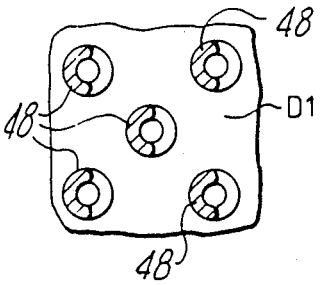
Fig.9B.
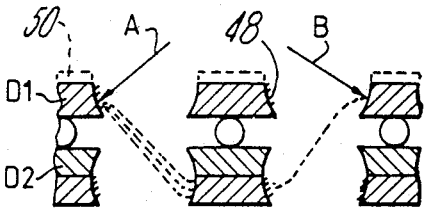
Fig.10.
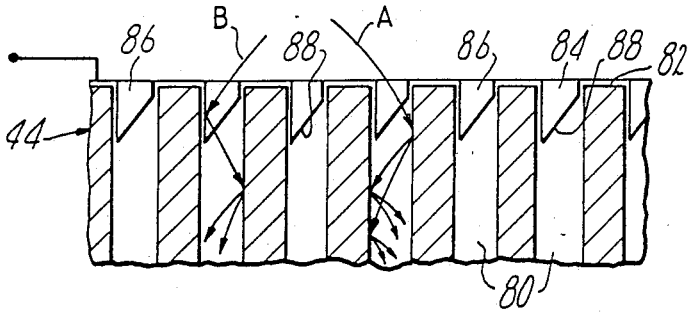
Fig.11 A.
Fig.11 B.
Fig.11 C.
Fig.11 D.
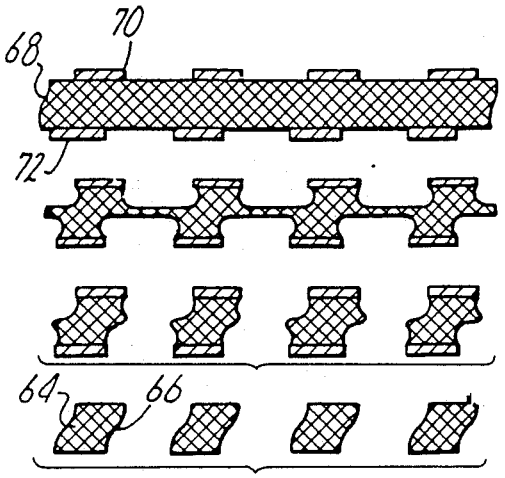

CATHODE RAY TUBE

This is a continuation of application Ser. No. 626,964, filed July 2, 1984, now abandoned.

BACKGROUND OF THE INVENTION

The present invention relates to a cathode ray tube, and particularly, but not exclusively, to a display tube having a channel plate electron multiplier and electrostatic beam scanning at the input side of the electron multiplier.

British patent specification No. 2101396A discloses such a display tube. Display tubes having channel plate electron multipliers are particularly susceptible to contrast degradation due to electrons being scattered from the input surface of the electron multiplier and entering channels at a point distant from their point of origin. In the case of electrostatically scanned display tubes, particularly flat display tubes, it is not possible to produce a positively biased field at the input side of the electron multiplier to draw-off back-scattered electrons because this would conflict with the field conditions necessary to achieve proper scanning of the incident electron beam, these field conditions being created by deflection electrodes held at the same potential or a more negative potential than the multiplier input.

It is an object of the present invention to reduce the contrast degradation due to back-scattered electrons in cathode ray tubes having a channel plate electron multiplier and especially those having electrostatic beam scanning.

According to the present invention there is provided a cathode ray tube comprising an envelope having an optically transparent faceplate, and within the envelope, means for producing an electron beam, a channel plate electron multiplier mounted adjacent to, but spaced from, the faceplate, scanning means for scanning the electron beam across an input side of the electron multiplier so that the electron beam approaches the input side along a path which is inclined thereto, and means at said input side for limiting the acceptance angle of the electron multiplier.

The present invention is based on the recognition of the fact that when an addressing electron beam is deflected in the manner described then its angle of approach to the input of the electron multiplier falls within a narrow range. In contrast back-scattered electrons will approach the input dynode at any angle and the effect of limiting the acceptance angle of the electron multiplier will be to exclude a large number of the back-scattered electrons from entering the channels of the electron multiplier.

The scanning means may comprise a carrier member spaced from and arranged substantially parallel to the input side of the electron multiplier, the carrier member having thereon a plurality of adjacent, substantially parallel electrodes which in response to voltages applied thereto deflect the electron beam from a path between the carrier member and the input side of the electron multiplier, towards said input side.

The acceptance angle may be limited in a number of ways depending on the form of the electron multiplier. If the electron multiplier comprises a laminated stack of discrete dynodes and it is desired to physically restrict the acceptance angle then this can be done by mounting inclined vanes on the input dynode or mounting one or more apertured electrodes on the input dynode, the or each electrode being offset relative to the input dynode and/or each other so that the apertures in the electrode(s) form correspondingly inclined passages to their associated channels in the electron multiplier. The apertures in the or each electrode may be slanted.

Another way of limiting the acceptance angle is to reduce the number of secondary emitting electrons produced by back-scattered electrons by applying secondary materials to corresponding restricted portions of the peripheries of the convergent apertures in the input dynode. In this way, the addressing electron beam strikes the secondary emitting material and produces many secondary electrons whereas back-scattered electrons which will approach the input dynode at other angles will strike the untreated areas of the hole peripheries and will produce significantly fewer secondary electrons.

Back-scatter from the input of the electron multiplier can be reduced further by masking the area between the apertures of the input of the electron multiplier with a layer of a material having a low back-scatter coefficient which material preferably has a low coefficient of secondary emission. In the present specification by a low back-scatter coefficient is meant less than that of a smooth carbon layer and by a low secondary emission coefficient is meant a value less than 2.0 for electrons in the energy range 300 to 500 eV.

It has been found desirable that either the surface onto which the layer is applied or the layer itself is microscopically rough. This reduces significantly the number of back-scattered electrons produced.

The layer of low back-scatter material may be applied to the input (or first) dynode of the electron multiplier or alternatively to the vanes or the apertured electrodes which are mounted on the input dynode to restrict the acceptance angle.

The low back-scatter material may comprise black chromium, black nickel, black copper, optionally coated with a conductive layer, such as carbon, which has a low secondary emission and/or low back-scatter coefficient, or anodised aluminum onto which an electrically conductive coating is applied.

In the case of the electron multiplier being a glass matrix electron multiplier having continuous channels and input and output electrodes applied to the input and output surfaces thereof, the input electrode is arranged to extend into the channels such that the portion in each channel has an inclined end, the direction of inclination being substantially the same for all channels. Such an electron multiplier is mounted so that the electron beam proper strikes the glass wall of each channel causing a relatively large number of secondary electrons to be produced whereas back-scattered electrons entering channels from different directions strike the extended portions of the input electrode and relatively few secondary electrons are produced in consequence.

BRIEF DESCRIPTION OF THE DRAWING

The present invention will now be described, by way of example, with reference to the accompanying drawings, wherein:

FIGS. 6, 7, 8, 9A, 9B and 10 are diagrammatic cross-sectional views of part of an electron multiplier and illustrate different ways of limiting the acceptance angle of the electron multiplier, and FIGS. 11A, 11B, 11C and 11D illustrate the various stages in making an electrode with slanted apertures.

In the drawings corresponding reference numerals have been used to indicate the same parts.

DESCRIPTION OF THE PREFERRED EMBODIMENTS

Figure 1:
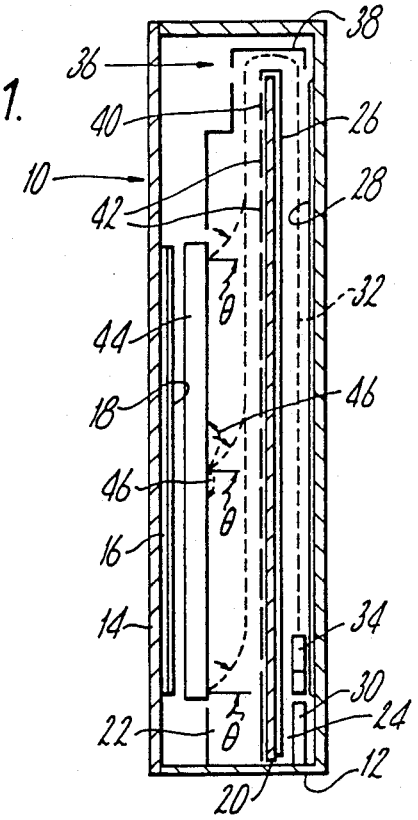
FIG. 1 is a cross section through a flat display tube which includes a channel plate electron multiplier.

The flat display tube 10 shown in FIG. 1 is of the type described and claimed in British patent specification No. 2101396A. A brief description of the display tube and its operation will now be given but for a fuller description reference should be made to specification No. 2101396A, details of which are incorporated by way of reference.

The flat display tube 10 comprises an envelope 12 including an optically transparent, planar faceplate 14. On the inside of the faceplate 14 is a phosphor screen 16 with an electrically conductive backing electrode 18 thereon.

For convenience of description, the interior of the envelope 12 is divided in a plane parallel to the faceplate 14 by an internal partition or divider 20 to form a front portion 22 and a rear portion 24. The divider 20, which comprises an insulator such as glass, extends for substantially a major part of the height of the envelope 12. A planar electrode 26 is provided on a rear side of the divider 20. The electrode 26 extends over the exposed edge of the divider 20 and continues for a short distance down its front side. Another electrode 28 is provided on the inside surface of a rear wall of the envelope 12.

Means 30 for producing an upwardly directed electron beam 32 is provided in the rear portion 24 adjacent a lower edge of the envelope 12. The means 30 may be an electron gun. An upwardly directed electrostatic line deflector 34 is spaced by a short distance from the final anode of the electron beam producing means 30 and is arranged substantially coaxially thereof. If desired the line deflector 34 may be electromagnetic.

At the upper end of the interior of the envelope 12 there is provided a reversing lens 36 comprising an inverted trough-like electrode 38 which is spaced above and disposed symmetrically with respect to the upper edge of the divider 20. By maintaining a potential difference between the electrodes 26 and 38 the electron beam 32 is reversed in direction whilst continuing along the same angular path from the line deflector 34.

On the front side of the divider 20 there are provided a plurality of laterally elongate, vertically spaced electrodes of which the uppermost electrode 40 may be narrower and acts as a correction electrode. The other electrodes 42 are selectively energised to provide frame deflection of the electron beam 32 onto the input surface of a laminated dynode electron multiplier 44. The laminated dynode electron multiplier 44 and its operation will be described in greater detail later with reference to FIG. 2. The electrons leaving the final dynode are accelerated towards the screen 16 by an accelerating field being maintained between the output of the electron multiplier 44 and the electrode 18.

In the operation of the display tube the following typical voltages are applied reference being made to 0 V the cathode potential of the electron gun 30. The electrodes 26, 28 in the rear portion 24 of the envelope 12 are at 400 V to define a field free space in which line deflection takes place with potential changes of about ±30 V applied to the line deflectors 34. The trough-like electrode 38 of the reversing lens is at 0 V compared to the 400 V of the extension of the electrode 26 over the top edge of the divider 20. The input surface of the electron multiplier 44 is at 400 V whilst at the beginning of each frame scan the electrodes 42 are at 0 V but are sequentially brought up to 400 V so that the electron beam 32 in the front portion 22 is initially deflected into the topmost apertures of the electron multiplier 44. As subsequent ones of the electrodes 42 are brought up to 400 V to form a field free space with the electron multiplier 44, the electron beam 32 is deflected towards the electron multiplier 44 in the vicinity of the next electrode 42 in the group to be at 0 V. It is to be noted that the landing angles $\theta$ of the electron beam 32 are fairly constant over the input side of the electron multiplier, these angles being typically between 30° and 40° in the illustrated embodiment. Assuming a potential difference of 3.0 kV across the electron multiplier 44 and allowing for the 400 V at the input side of the multiplier, then the potential at the output side is equal to 3.4 kV. The electrode 18 is typically at a potential of 11 kV to form an accelerating field between the output side of the electron multiplier 44 and the screen 16.

Because the frame deflection electrodes 42 are at the same voltage or less with reference to the input surface of the electron multiplier 44 then any back-scatter electrons 46 produced by scattering of the input electrons, particularly in bright areas of an image being reproduced, are caused to enter channels of the electron multiplier 44 at other points which leads to a degradation of contrast. Back-scatter electrons are those electrons having energies greater than 50 eV.

Two approaches to overcome this degradation of contrast will be described with reference to FIGS. 2 to 10. In summary these approaches are to reduce back-scattered electrons by (1) covering the input surface, apart from the channel openings with a material having a low back-scatter coefficient, and (2) limiting the acceptance angle of the electron multiplier. Approaches (1) and (2) can be used either independently or together.

Figure 2:
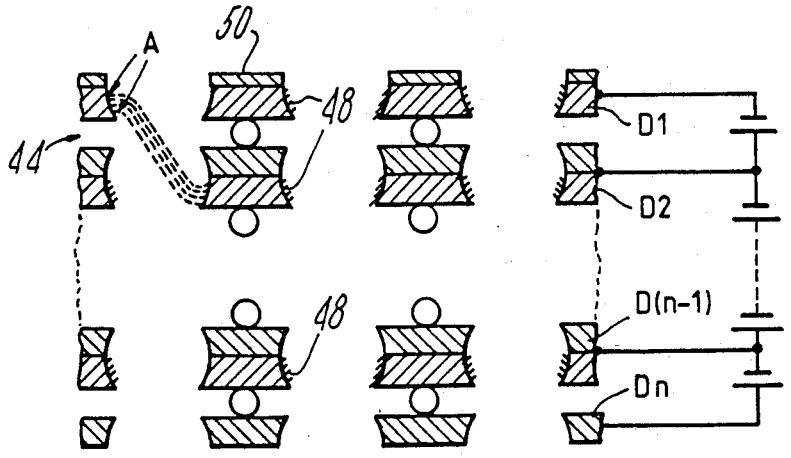
FIG. 2 is a diagrammatic cross-sectional view through a laminated plate electron multiplier having a material with a low back-scatter coefficient applied to the input dynode.

Referring to FIG. 2, the laminated dynode electron multiplier 44 and its operation is described in a number of published patent specifications of which British patent specification Nos. 1401969, 1434053 and 2023332B are but a few examples. Accordingly only a brief description of the electron multiplier 44 will be given.

The electron multiplier 44 comprises a stack of n spaced apart, apertured dynodes, referenced D1 to Dn, held at progressively higher voltages, the potential difference between adjacent dynodes being in a typical range of 200 to 500 V. The apertures in the dynodes are aligned to form channels. The dynodes are made from etched mild steel plates. Dynodes D2 to D(n−1) have re-entrant apertures and these are formed by etching convergent apertures in the mild steel plates and assembling them in pairs with the smaller cross-sectional openings facing outwards.

The first and last dynodes D1 and Dn, respectively comprise single mild steel sheets. As mild steel is not a good secondary emitter, a secondary emitting material 48, such as magnesium oxide, is deposited in the apertures of the first dynode D1 and the lower half of each dynode D2 to D(n−1) as shown in FIG. 2. Primary electrons A striking the wall of an aperture in the first dynode D1 produce a number of secondary electrons, each of which on impacting with the wall of an aligned aperture in the second dynode D2 produce more secondary electrons (not shown) and so on. The stream of electrons leaving the final dynode Dn, which acts as a focusing electrode, are accelerated to the screen (not shown in FIG. 2).

Primary electrons striking the area of the first dynode D1 between the apertures may give rise to back-scattered electrons which enter apertures remote from their point of origin causing the contrast of the image viewed on the screen (not shown) to be degraded. In order to reduce the occurrence of back-scattered electrons, particularly high energy ones, a layer 50 of a material having a low back-scatter coefficient and preferably also a low secondary emission coefficient is applied to the first dynode D1 in the area between the apertures in the first dynode D1.

Figure 3A:
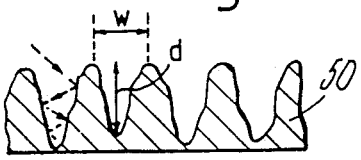
FIGS. 3A and 3B are diagrammatic cross-sectional views of two alternative rough surfaces.
Figure 3B:
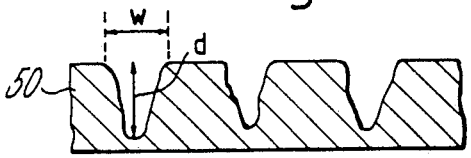

In order to be effective it has been found that the surface onto which the layer 50 is applied and/or the material itself should be microscopically rough as shown in FIGS. 3A and 3B. The roughness should be such that the distance w between adjacent peaks should be less than the distance, d, from the peaks to the intervening trough. Electrons entering the cavities undergo several reflections, each time losing energy. Thus even if they escape from the cavity they will not travel far thus not seriously degrading the contrast of a reproduced image.

Various materials have been found to be suitable for the layer 50, some of these materials produce their roughness by having a modular surface, FIG. 3A, and others of these materials produce their roughness by forming pits in an otherwise flat surface, FIG. 3B.

Materials producing a nodular surface which has been found to reduce back-scattering are black chromium plated on electroless nickel-coated steel, black copper plated on electroless nickel-coated steel and carbon coated black copper plated on electroless nickel-coated steel. Two materials producing a pitted type of surface are acid treated, electroless nickel and anodised, aluminum plated steel which has been carbon coated to provide a conductive surface to prevent charging. Taking both performance and ease of processing points of view into consideration the best of the above materials is carbon coated black copper. Another factor in providing a carbon coating is that it reduces the secondary emission and the back-scattering coefficient from the roughened surfaces.

Instead of applying the material 50 to the first dynode D1, the material 50 can be applied to a carrier electrode 52 which is electrically and physically connected, for example by spot welding, to the first dynode D1.

Figure 4:
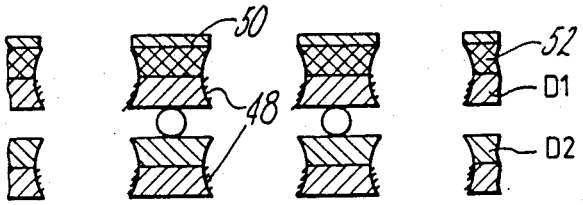
FIGS. 4 and 5 are diagrammatic cross-sectional views through the first two dynodes of an electron multiplier showing two different ways of mounting layers of material with a low back-scatter coefficient.

In FIG. 4 the carrier electrode 52 conveniently comprises a half dynode to which the material 50 is applied prior to it being connected to the first dynode D1. As shown re-entrant apertures are formed by the combination of the carrier electrode 52 and the first dynode D1.

Figure 5:
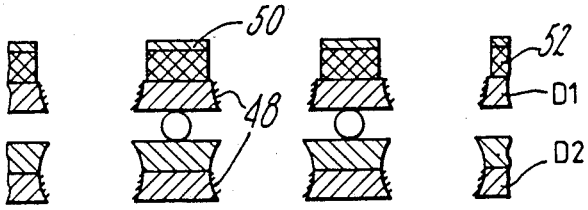

The arrangement shown in FIG. 5 differs from that shown in FIG. 4 in that the apertures in the carrier electrode 52 are substantially straight-sided rather than divergent and the cross-sectional size of these apertures corresponds to the openings in the adjoining surface of the first dynode D1. Conveniently the straight-sided apertures can be made by overetching the apertures in a half dynode to be used as the carrier electrode.

FIGS. 6 to 10 show various embodiments in which the approach angle of electrons in the addressing beam is limited. In FIG. 1 the angle $\theta$ is substantially constant and is in the range 30° to 40°. Thus by limiting the approach angle (90°-$\theta$) to between 50° and 60° then electrons having different approach angles will not enter the electron multiplier 44 and in so doing this will eliminate the majority of the back-scattered electrons. Optionally the outermost surfaces in FIGS. 6 to 8 and 10 may be covered by a layer 50 of material having a low back-scatter coefficient, this is indicated in broken lines.

Figure 6:
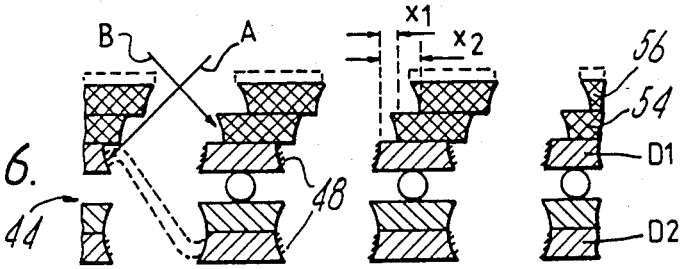

Referring more particularly to FIG. 6, the means for limiting the approach angle comprises two apertured electrodes 54, 56 electrically and physically connected to the first dynode D1. The size and pitch of the apertures in the electrodes 54, 56 correspond to that of the first dynode but the electrode 54 is offset by a predetermined amount $x_1$ relative to the first dynode D1 and the electrode 56 is offset in the same direction relative to the electrode 54 and the dynode D1 by an overall amount $x_2$ so that together they define inclined paths or channels to the first dynode D1. By way of example for an electron multiplier 44 in which the thickness of each of the electrodes 54, 56 and the first dynode D1 is 0.15 mm, the pitch of the apertures is 0.772 mm, $x_1 \times 0.17$ mm and $x_2 \times 0.225$ mm. If desired the apertures in the electrodes may be elongate in a direction normal to the plane of the drawing. In operation the primary electrons denoted by the arrow A strike the secondary emitting material 48 of the first dynode D1 and produce secondary electrons which are drawn through to the second dynode D2. However, electrons such as those denoted by the arrow B strike the electrode 54 and produce a small number of secondaries because of the low secondary emission coefficient of mild steel. Although this small number of secondaries may undergo electron multiplication their contribution to the brightness of the image is small.

Figure 7:
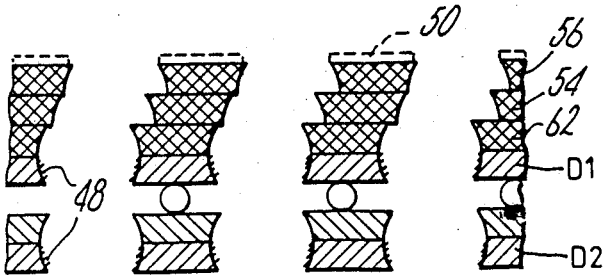

The embodiment shown in FIG. 7 is a variant of that shown in FIG. 6 in that an additional electrode 62 is disposed with zero offset between the first dynode D1 and the electrode 54. Because the apertures in the electrode 62 are downwardly divergent, as shown in FIG. 7, then together with the apertures in the first dynode D1 they form re-entrant apertures.

In the embodiment shown in FIG. 8 the inclined paths to the first dynode D1 are formed by metal vanes 58 forming a Venetian blind type of structure over the multiplier input. If the height h of each vane 58 is greater than the distance, p, between them then the vanes may either be formed individually and bonded on to the input dynode D1 by for example glass enamel 60, or be preformed from single sheets of metal, several of which are mounted, each offset from the other by an appropriate integral multiple of the distance p. Alternatively if the height, h, is less than, or equal to, the distance p then the vanes 58 can be pressed out of a single sheet of metal. In operation electrons having trajectories indicated by the arrow A will undergo electron multiplication but those having other trajectories, for example as denoted by the arrows B and C, strike the vanes 58 and any back-scattered electrons follow trajectories where they are unlikely to enter channels of the electron multiplier 44.

FIGS. 9A and 9B illustrate another approach to limiting the acceptance angle of the current multiplier. In this embodiment, secondary emitting material 48 is applied to a restricted area of each aperture in the first dynode D1. In use electrons arriving in the direction denoted by the arrow A strike the secondary emitting material 48 and produce a large number of secondary electrons which are drawn through to the second dynode D2. However stray or back-scattered electrons arriving in the direction B strike the portion of the periphery of an aperture which has a low secondary emission coefficient thus producing very few secondary electrons compared to the situation if the secondary emitting material was there.

FIG. 10 illustrates an approach to limiting the acceptance angle which can be used with a glass matrix micro channel plate electron multiplier 44 having continuous channels 80 extending substantially normally to the input side 82 and the output side (not shown) of the electron multiplier 44. An input electrode 84 is provided on the input side 82 and another, output electrode (not shown) is provided on the output side. However the input electrode 84, unlike the output electrode (not shown), has portions 86 which extend into each channel 80. The portions 86 terminate in similarly inclined ends 88 which are made possible by evaporating the input electrode 84 onto the multiplier 44 from one side.

In use the electron multiplier 44 is arranged so that the taper of the inclined ends 88 points away from the direction of the electron beam. Thus the primary electrons A of the scanned beam on entering the channels 80 of the electron multiplier 44 strike the glass wall and produce a relatively large number of secondary electrons. However back-scattered electrons which generally enter the channels 80 at other angles, for example see the electrons B, strike the portion 86 of the input electrode 84 extending into the respective channel and cause very few secondary electrons to be produced thus not significantly affecting the contrast of the image which is displayed on the screen 28 (FIG. 1).

FIGS. 11A to 11D show the steps in making an electrode 64 having slanted apertures 66. The material of the electrode 64 comprises a sheet 68 of mild steel having a thickness at least equal to that of a half dynode. Offset photoresist patterns 70, 72 are applied to opposite sides of the sheet 68. Double sided etching is commenced as shown in FIG. 11B. In due course the holes formed in each side break through, see FIG. 11C. Etching is continued until the slanting holes 66 are formed, thereafter etching is stopped and the photoresist patterns 70, 72 are removed to leave the electrode 64 as shown in FIG. 11D.

In use the electrode 64 is electrically and physically connected to the first dynode D1 and optionally a layer 50 of material having a low back-scatter coefficient is applied.

We claim:

1. A cathode ray tube comprising an envelope including an optically transparent faceplate supporting a luminescent screen, said envelope containing:

(a) a channel plate electron multiplier having an output side spaced from said luminescent screen and having an input side including a multiplicity of openings defining entrances to respective channels having walls including secondary emissive material;

(b) means for producing a scanning electron beam and for directing said beam at the input side of the channel plate electron multiplier such that the beam is received at the input side from substantially a predetermined direction and at substantially a predetermined angle of incidence;

said beam, when scanned across areas of said input side disposed between the openings, producing backscattered electrons which return to said input side from random directions and at random angles; and (c) acceptance angle limiting means arranged near the channel entrances for allowing electrons arriving from substantially the predetermined direction and at substantially the predetermined angle of incidence of the electron beam to strike the secondary emissive material in the channels, but inhibiting electrons arriving from other directions and at other angles from striking the secondary emissive material in the channels, thereby minimizing multiplication in said channels of the backscattered electrons.

2. A cathode ray tube comprising an envelope including an optically transparent faceplate supporting a luminescent screen, said envelope containing:

(a) a channel plate electron multiplier having an output side spaced from said luminescent screen and having an input side including a multiplicity of openings defining entrances to respective channels having walls including secondary emissive material;

(b) means for producing a scanning electron beam and for directing said beam at the input side of the channel plate electron multiplier such that the beam is received at the input side from substantially a predetermined direction and at substantially a predetermined angle of incidence, said beam, when scanned across areas of said input side disposed between the openings, producing backscattered electrons which return to said input side from random directions and at random angles; and (c) acceptance angle limiting means comprising tilted vanes mounted at the input side and arranged near the channel entrances for allowing electrons arriving from substantially the predetermined direction and at substantially the predetermined angle of incidence of the electron beam to strike the secondary emissive material in the channels, but inhibiting electrons arriving from other directions and at other angles from striking the secondary emissive material in the channels, thereby minimizing multiplication in said channels of the backscattered electrons.

3. A cathode ray tube comprising an envelope including an optically transparent faceplate supporting a luminescent screen, said envelope containing:

(a) a channel plate electron multiplier having an output side spaced from said luminescent screen and having an input side including a multiplicity of openings defining entrances to respective channels having walls including secondary emissive material;

(b) means for producing a scanning electron beam and for directing said beam at the input side of the channel plate electron multiplier such that the beam is received at the input side from substantially a predetermined direction and at substantially a predetermined angle of incidence, said beam, when scanned across areas of said input side disposed between the openings, producing backscattered electrons which return to said input side from random directions and at random angles; and (c) acceptance angle limiting means comprising at least two superimposed apertured electrodes mounted at the input side, the apertures in said electrodes corresponding with the openings in said input side, the electrodes being offset relative to each other and the input to form inclined entrance passages for selectively admitting into the channels electrons arriving from substantially the predetermined direction and at substantially the predetermined angle of incidence, thereby minimizing multiplication in said channels of the backscattered electrons.

4. A cathode ray tube comprising an envelope including an optically transparent faceplate supporting a luminescent screen, said envelope containing:

(a) a channel plate electron multiplier having an output side spaced from said luminescent screen and having an input side including a multiplicity of openings defining entrances to respective channels having walls including secondary emissive material;

(b) means for producing a scanning electron beam and for directing said beam at the input side of the channel plate electron multiplier such that the beam is received at the input side from substantially a predetermined direction and at substantially a predetermined angle of incidence, said beam, when scanned across areas of said input side disposed between the openings, producing backscattered electrons which return to said input side from random directions and at random angles; and (c) acceptance angle limiting means comprising an apertured electrode mounted at the input side, the apertures in said electrode corresponding with the openings in said input side and being slanted to form inclined entrance passages for selectively admitting into the channels electrons arriving from substantially the predetermined direction and at substantially the predetermined angle of incidence, thereby minimizing multiplication in said channels of the backscattered electrons.

5. A cathode ray tube comprising an envelope including an optically transparent faceplate supporting a luminescent screen, said envelope containing:

(a) a channel plate electron multiplier having an output side spaced from said luminescent screen and having an input side including a multiplicity of openings defining entrances to respective channels having walls including secondary emissive material;

(b) means for producing a scanning electron beam and for directing said beam at the input side of the channel plate electron multiplier such that the beam is received at the input side from substantially a predetermined direction and at substantially a predetermined angle of incidence, said beam, when scanned across areas of said input side disposed between the openings, producing backscattered electrons which return to said input side from random directions and at random angles; and (c) acceptance angle limiting means comprising secondary emissive material selectively applied to only those portions of the channel entrances struck by electrons arriving from substantially the predetermined direction and at substantially the predetermined angle of incidence, thereby minimizing multiplication in the channels of the backscattered electrons.

6. A cathode ray tube as in claim 1, 2, 3, 4 or 5 where the channel plate electron multiplier comprises a laminated stack of discrete dynodes.

7. A cathode ray tube comprising an envelope including an optically transparent faceplate supporting a luminescent screen, said envelope containing:

(a) a glass matrix channel plate electron multiplier having an output side spaced from said luminescent screen and having an input side including a multiplicity of openings defining entrances to respective continuous channels having walls including secondary emissive material, said input side bearing an input electrode having openings aligned with respective entrances of the channels;

(b) means for producing a scanning electron beam and for directing said beam at the input side of the channel plate electron multiplier such that the beam is received at the input side from substantially a predetermined direction and at substantially a predetermined angle of incidence; and (c) acceptance angle limiting means comprising extensions of said input electrode into said channels, each of said extensions covering portions of the respective channel walls struck by any arriving electrons which do not arrive from substantially the predetermined direction and at substantially the predetermined angle of incidence, thereby minimizing multiplication in said channels of the backscattered electrons.

8. A cathode ray tube as in claim 1,2,3,4,5 or 7 including a layer of a material having a low back scattering coefficient disposed at the input side of the channel plate electron multiplier.

9. A cathode ray tube as in claim 8 where the layer of material also has a low secondary emission coefficient.

10. A cathode ray tube as in claim 8 where the layer of material has a microscopically-rough surface.

11. A cathode ray tube as in claim 10 where the layer of material consists essentially of black chromium.

12. A cathode ray tube as in claim 10 where the layer of material consists essentially of black nickel.

13. A cathode ray tube as in claim 10 where the layer of material consists essentially of black copper.

14. A cathode ray tube as in claim 10, where the layer of material consists essentially of a black metal.

15. A cathode ray tube as in claim 14 including an electrically conductive coating having a low secondary emission coefficient applied to the black metal layer.

16. A cathode ray tube as in claim 14 including an electrically conductive coating having a low back scatter coeffient applied to the black metal layer.

17. A cathode ray tube as in claim 10 where the layer of material consists essentially of anodized aluminum and where an electrically conductive coating is applied to said layer of material.

* * * * *